US005978640A

United States Patent [19]

Segawa

[11] Patent Number: 5,978,640

[45] Date of Patent: Nov. 2, 1999

[54] ELECTROSTATOGRAPHIC RECYCLABLE CLEANING UNIT AND USE METHOD

[75] Inventor: Yuichi Segawa, Osaka, Japan

[73] Assignee: Mita Industrial Co., Ltd., Osaka, Japan

[21] Appl. No.: 09/121,830

[22] Filed: Jul. 24, 1998

[30] Foreign Application Priority Data

Jul. 26, 1997 [JP] Japan ..... 9-215854

[51] Int. Cl.[6] ..... G03G 15/20

[52] U.S. Cl. ..... 399/327; 399/325; 399/326

[58] Field of Search ..... 399/325–327; 15/256.51

[56] References Cited

U.S. PATENT DOCUMENTS 5,045,890 9/1991 DeBolt et al. ..... 399/325

FOREIGN PATENT DOCUMENTS 7-140830 6/1995 Japan .
7-234601 9/1995 Japan .
8-087194 4/1996 Japan .

*Primary Examiner*—Matthew S. Smith
*Attorney, Agent, or Firm*—Shinjyu An Intellectual Property Firm

[57] ABSTRACT

A configuration and method are disclosed for recyclably using a fixing roller cleaning device in an electrostatographic fixing station. In a principal embodiment, the cleaning device includes a cleaning web unit 13 installable in cassette fashion into a corresponding unit loading receptacle 14(15) disposed axially adjacent either fixing roller in the top and bottom ends of the fixing station. On the heating roller 3 end, the cleaning web unit 13 contains an unused disposable cleaning web 12. Therein side A of the cleaning web 12 winding between feed and take-up sections 16 and 17 of a web winding mechanism 18 serves in heavy-duty cleaning of, and application of sheet-parting agent to, the surface of the heating roller 3. Afterwards, the cleaning web unit 13 is withdrawn from location on the heating roller 3 end, turned round horizontally, and installed in location beneath the pressure roller 4 end of the fixing station. Therein reverse side B of the cleaning web 12 serves in light duty cleaning of, and application of parting agent to, the surface of the pressure roller 4.

12 Claims, 5 Drawing Sheets

ELECTROSTATOGRAPHIC RECYCLABLE CLEANING UNIT AND USE METHOD

BACKGROUND OF THE INVENTION

1. Technical Field

The present invention relates to cleaning web devices in the fixing station of electrostatographic printing apparatuses, such as electrostatic photocopying machines, printers, and facsimile machines; in particular the present invention relates to the recycling use of such cleaning web devices.

2. Description of Related Art

In electrostatographic printing devices, printing sheets carrying a toner-developed image are conveyed to a fixing station typically having a heating roller against which a pressure roller presses. The toner image is fuse-fixed onto the printing sheets as they are nipped by the pair of rollers in conveyance to the fixing station. In the fixing process, toner particles thus cling to the surface of the heating roller, and consequently a cleaning device is provided in the fixing station for cleaning the heating roller.

Toner that does not get cleaned from the surface of the heating roller may stick to the surface of the pressure roller due to its different separative properties from the heating roller. Further, in double-sided image fixing processes in electrostatographic printing devices, toner may stick to the surface of the pressure roller. Consequently, a cleaning device for the pressure roller is also provided.

Examples of such cleaning devices include unit devices in which a cleaning web that is prepared by impregnating a heat-resistant paper or the like with a parting agent such as silicone oil is stretched from a web feed reel to a web take-up real, bringing one surface of the cleaning web into contact with the roller surface to be cleaned. The cleaning web is wound at a predetermined rate, and as the roller it contacts rotates, toner sticking to the roller surface is stripped off by the cleaning web.

A problem in thus employing a cleaning web, however, is that in bringing the web into cleaning contact with the roller a major portion of the parting agent contained in the web is applied to the roller surface. Accordingly, wherein after using one side of a cleaning web, the other side is to be used for another roller cleaning, the amount of parting agent applied to the surface of the roller is insufficient. Therefore, under the present circumstances only one side of the cleaning web is generally used and then it discarded.

Thus disposing of the cleaning web is, however, quite uneconomical.

Toward overcoming the forgoing problems, JP-A-140830/1995, in pursuing economy of use, discloses a technique in which a used cleaning web is reversed and re-extended between web feed and web take-up sections, and in order to compensate for the lack of parting agent remaining for application to the roller surface to be cleaned, the winding speed after reversing the web is increased over that prior to reversing, in order to equalize the quantity of parting agent applied by either side of the web. Unfortunately, it is very difficult to adjust the amount of parting agent applied in this manner; moreover the structure entailed is complex, increase the overall cost of the cleaning web unit.

SUMMARY OF THE INVENTION

It is, accordingly, an object of the present invention to configure a disposable cleaning web unit in a simple conformation for recyclable use, enabling efficient and economical cleaning of the heating and pressure rollers in the fixing station of an electrostatographic printing apparatus.

At the same time, an object of the invention is a method of recyclable use enabled by a cleaning web unit thus configured.

In accordance with the present invention, a method of recyclably using a cleaning web in cleaning the fixing rollers of an electrostatographic fixing station wherein a cleaning web of a cleaning web device is installed to be nipped against the surface of a heating roller in an upper end of the fixing station, and wherein the cleaning web in recycled use is installed to be nipped against a fixing station pressure roller pressibly riding on the heating roller. The cleaning web cleans the fixing station roller surfaces as the as the rollers rotate.

The method is characterized in that: an unused cleaning web containing a parting agent and wound in a roll is installed for winding from a web feeding section to a web take-up section of the cleaning web device disposed on the heating roller end, wherein one side of the cleaning web is brought into cleaning contact with the surface of the heating roller. A cleaning web used on the heating roller end is subsequently installed for winding from a web feeding section to a web take-up section of the cleaning web device as disposed on the pressure roller end, wherein the other side of the cleaning web is then brought into cleaning contact with the surface of the pressure roller.

In accordance with another aspect of the invention, a cleaning web device is configured for recyclable use in an electrostatographic fixing station. The fixing station includes a heating roller and a pressure roller pressing on the heating roller. The cleaning web device therein includes a pair of unit loading receptacles, one disposed axially adjacent the heating roller and the other disposed axially adjacent the pressure roller; web-pressing mechanisms directed to either the heating roller or the pressure roller; an axially symmetrical case defining parallel axial roller housings and having a central through-hole through which the web-pressing mechanisms are operable; and a pair of web winding rollers, one housed in each axial roller housing, mounted therein on respective axles for feed and take-up.

The cleaning web unit is thus installable into a unit loading receptacle axially adjacent the heating roller in a first orientation, wherein the heating roller web-pressing mechanism presses one surface of the cleaning web through the through-hole against the heating roller. Likewise, the cleaning web unit is installable into a unit loading receptacle axially adjacent the pressure roller in the first orientation and in a second orientation, the second orientation being the first orientation turned approximately 180° around an axis perpendicular to the axles for feed and take-up, wherein the pressure roller web-pressing mechanism presses the other surface of the cleaning web through the through-hole against the pressure roller.

Thus, the cleaning web device and method for recyclably using a cleaning unit in an electrostatographic fixing station in accordance with the present invention take advantage of the fact that wherein an unused cleaning web is initially employed for cleaning the heating roller, functionally sufficient sheet-parting agent is applied to the heating roller. Yet at the same time, parting agent is also applied to the pressure roller pressibly riding on the heating roller; therefore, the pressure roller can be sufficiently cleaned recyclably employing the reverse side of the used cleaning web, even though it therein has a reduced amount of parting agent compared to that required to clean the heating roller.

Thus, the foregoing cleaning web method and cleaning web device, wherein the surface of the heating roller is cleaned by the one side of an unused cleaning web, and the surface of the pressure roller is then cleaned by the other side of the recycled cleaning web originally used in cleaning the heating roller, enables economical and efficient cleaning of the heating roller and the pressure roller. Accordingly, both sides of the disposable cleaning web that has conventionally been discarded after use in cleaning the heating roller alone are substantially utilized, moreover eliminating the need for any technique of adjusting the amount of a parting agent applied to the respective fixing rollers.

The foregoing and other objects, features, aspects and advantages of the present invention will become more apparent from the following detailed description, when taken in conjunction with the accompanying drawings.

DETAILED DESCRIPTION OF THE PREFERRED EMBODIMENTS

Figure 1:
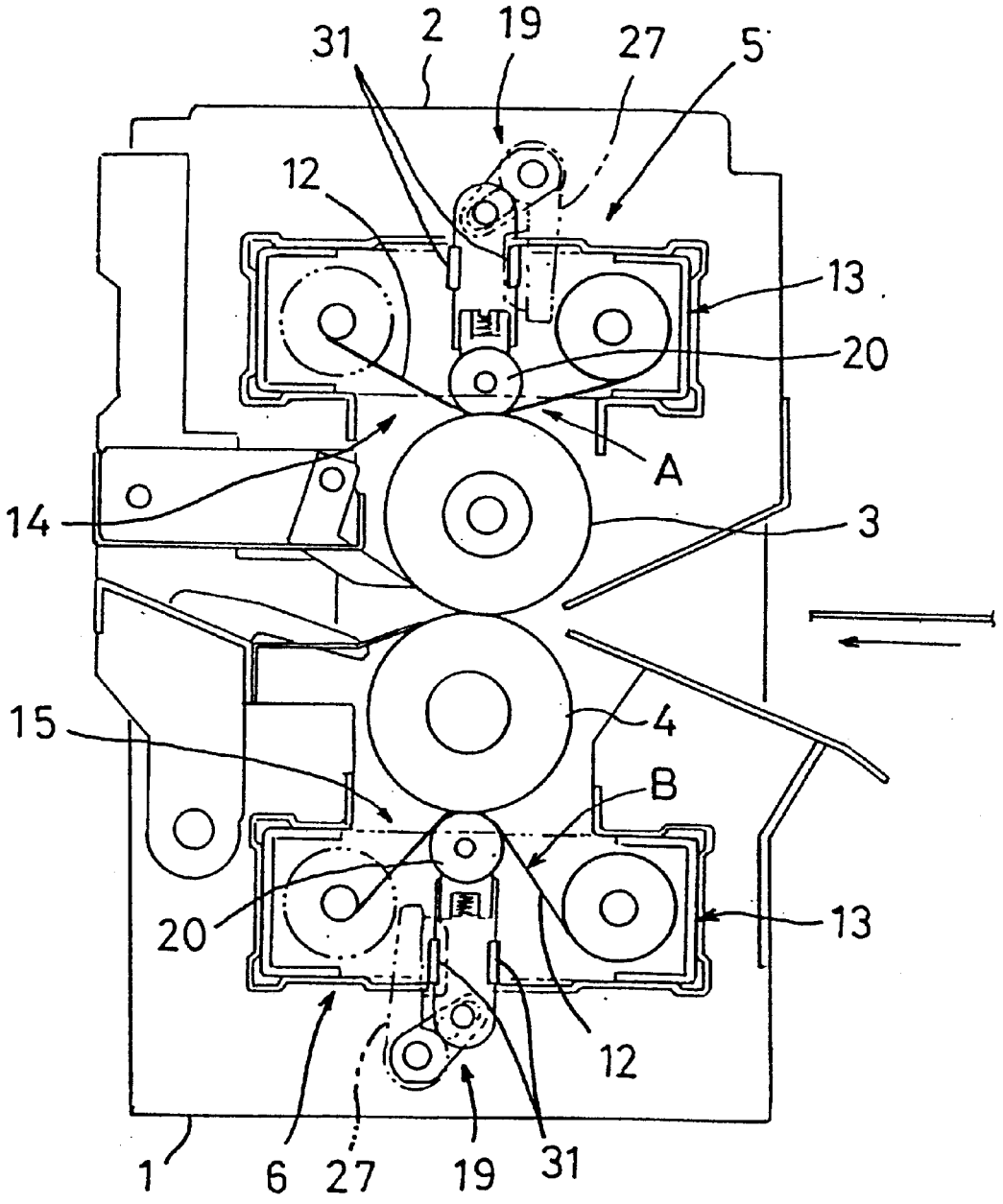
FIG. 1 is cross-sectional elevation of a fixing station in an electrostatographic printing apparatus in which cleaning web devices in accordance with the present invention are installed.

FIG. 1 illustrates a fixing station wherein a principal embodiment of the present invention is installed in an electrostatic photocopying machine (as an example of an electrostatographic printing apparatus). A heating roller 3 is disposed in an upper case 2 openable on a lower case 1. A pressure roller 4 that is pressed against the heating roller 3 wherein the upper and lower cases 1, 2 are shut together for operation is disposed in the lower case 1. Cleaning web devices 5 and 6 are provided respectively for the heating roller 3 and the pressure roller 4.

Figure 3:
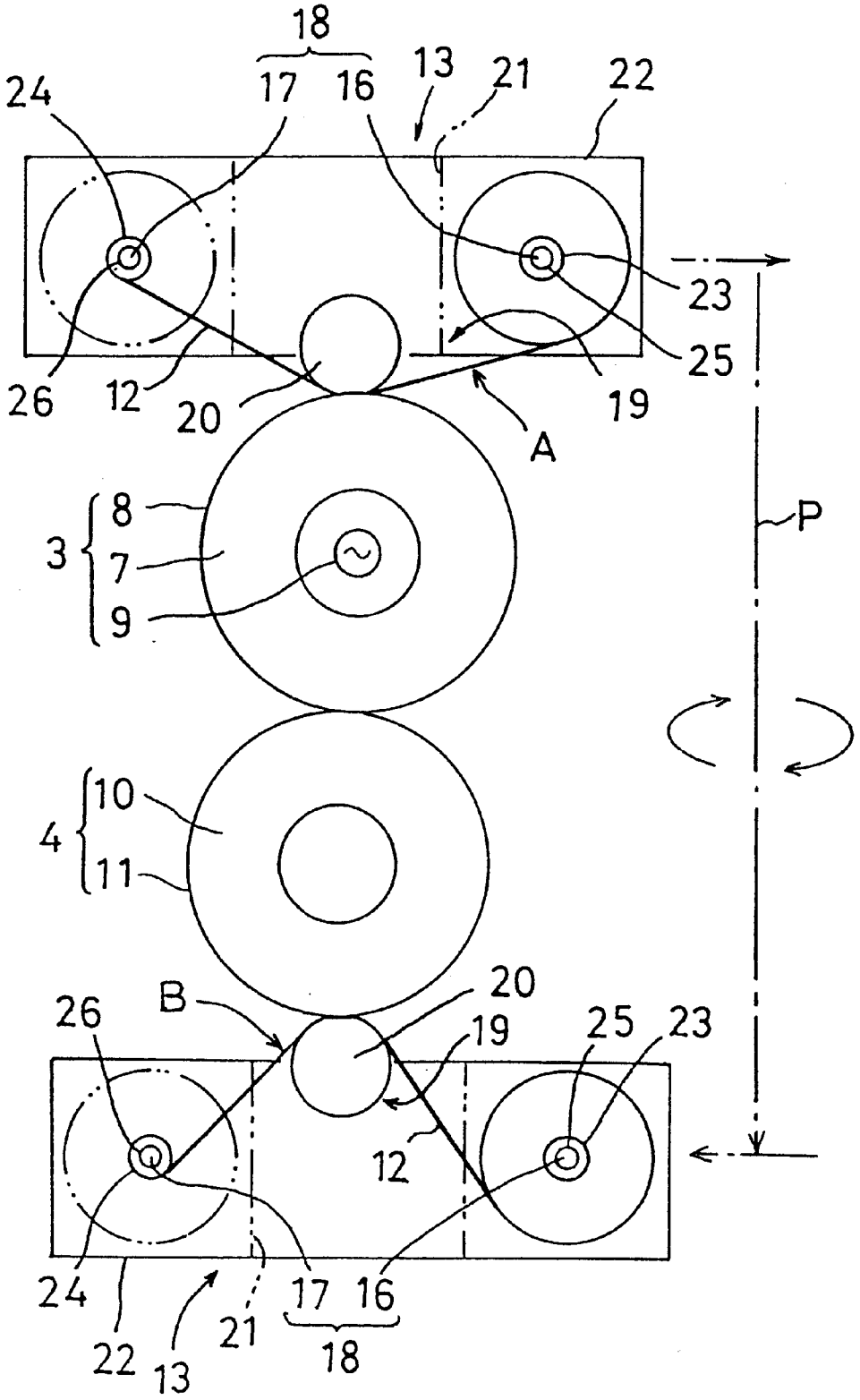
FIG. 3 is a schematic view corresponding to FIG. 1, illustrating the cleaning web of a fresh cleaning web unit loaded against the heating roller and the cleaning web of a recycled cleaning web unit loaded against the pressure roller.

Referring to FIG. 3, the heating roller 3 is formed by furnishing a roller tube 7 of metal (aluminum for example) with a fluorocarbon coating layer 8 and a heating element 9 housed within the roller cylinder 7. The pressure roller 4 is formed by furnishing a roller core 10 of metal (aluminum for example) with a coating layer 11 made of a heat-resistant elastic body (silicone rubber for example). As need be, a heater may also be provided in the pressure roller 4.

Figure 2:
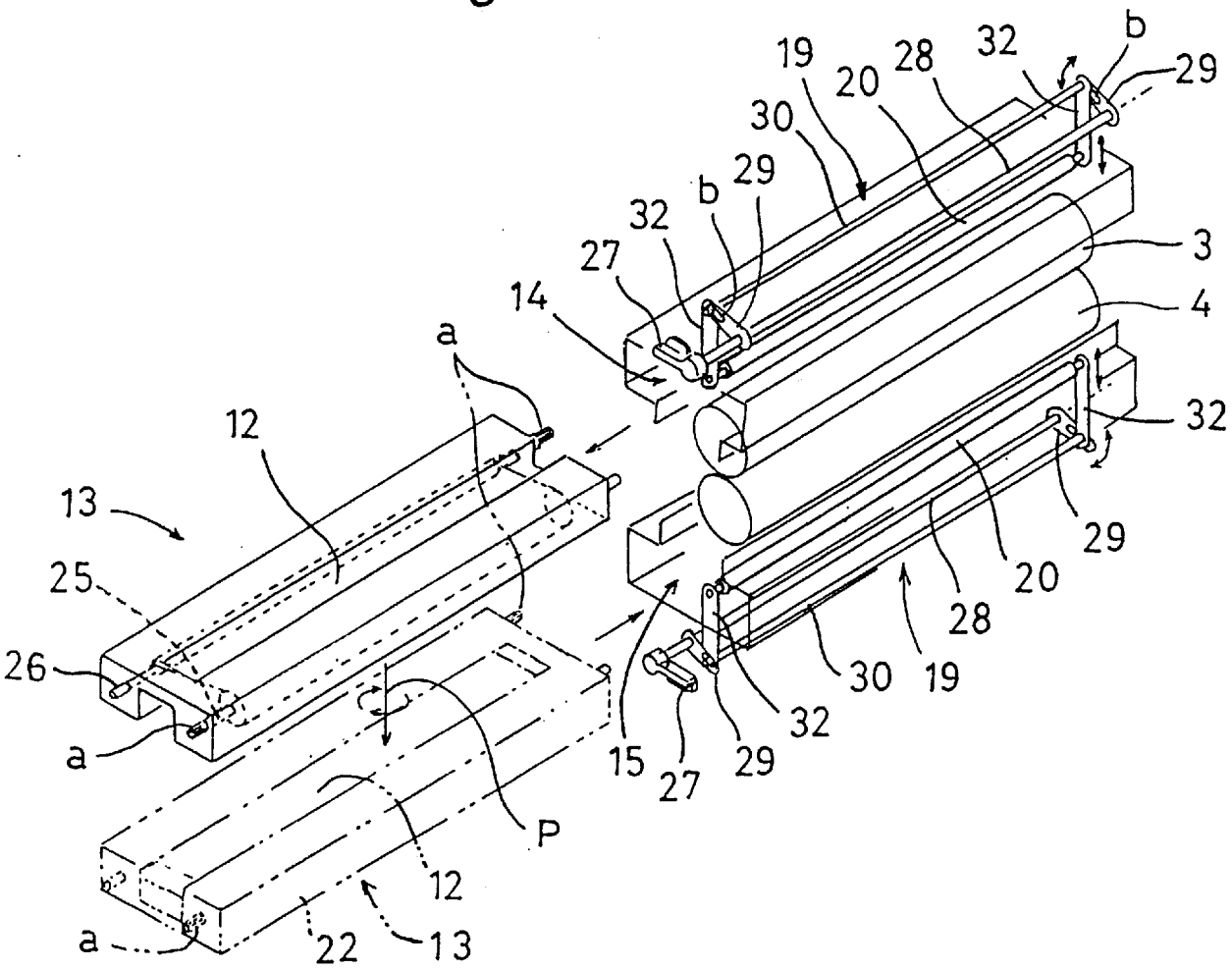
FIG. 2 is an oblique view of a pair cleaning web units shown withdrawn from respective unit loading receptacles disposed adjacent heating and pressure rollers of the fixing station, with the cleaning web in the top unit of the pair indicated by hidden lines, and with the bottom unit shown in phantom.
Figure 4:
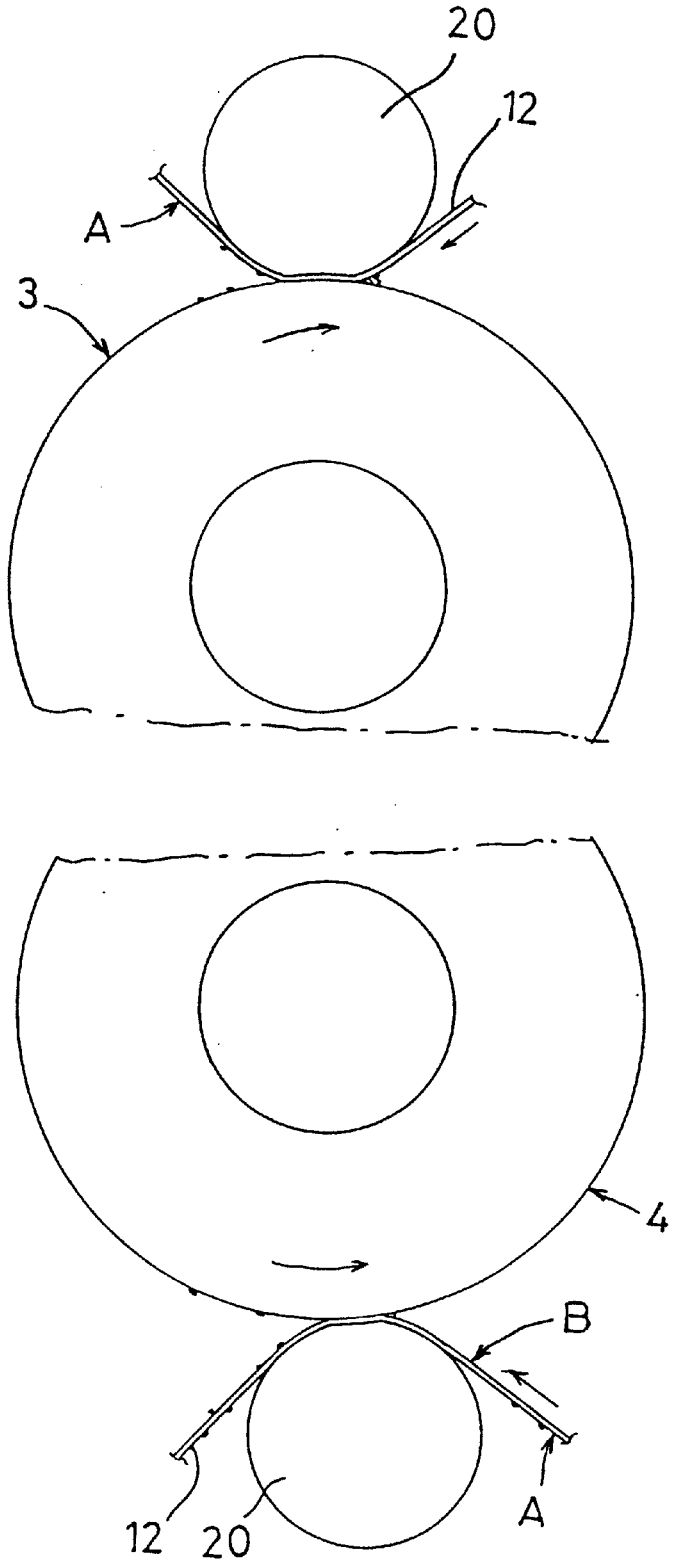
FIG. 4 is an enlarged schematic view corresponding to FIG. 3, illustrating the surface of a partially shown heating roller being cleaned by one side of a fresh cleaning web, and the surface of a partially shown pressure roller being cleaned by the opposite side of the cleaning web in recycled use.

Cleaning web device 5, disposed above the heating roller 3, as depicted in FIGS. 2 and 4, includes a unit housing 13 containing a cleaning web 12, a unit loading receptacle 14 into which the unit housing 13 fits, and a web winding means 18 installed in the unit loading receptacle 14. The web winding means 18 comprises a web feeding section 16 and a web take-up section 17, and winds the cleaning web 12 little by little at a predetermined rate. Cleaning web device 6 includes a unit loading receptacle 15 disposed underneath the pressure roller 4, and a web winding means 18 (likewise having a web feeding section 16 and a web take-up section 17), which winds the cleaning web 12 little by little at a predetermined rate, installed in the unit loading receptacle 15. The unit loading receptacle 15 is for insertably/withdrawably loading a used cleaning unit 13 in an orientation in which, being on the heating roller 3 side, it is pulled out from the unit loading receptacle 14 and is inverted 180 degrees around an axis P perpendicular to the web surface.

Web pressing means 19, 19 are provided for the unit loading receptacles 14 and 15, respectively, such that in the unit loading receptacle 14 on the heating roller 3 end, one side A of a web of an unused cleaning unit 13 is pressed against the surface of the heating roller 3, and such that in the unit loading receptacle 15 on the pressure roller 4 end, the other side B of a web that has been used on the heating roller 3 side is pressed against the surface of the pressure roller 4.

That is, with an unused cleaning unit 13 set into the unit loading receptacle 14 on the heating roller 3 end, the surface of the heating roller 3 is cleaned by one side A of the cleaning web 12. When the cleaning web 12 is used up, the cleaning unit 13 is set into the unit loading receptacle 15 on the pressure roller 4 side, whereby the other side B of the cleaning web 12 cleans the surface of the pressure roller 4. This produces economical cleaning of the heating roller 3 and the pressure roller 4 by using both sides of the cleaning web 12.

In the cleaning unit 13, through-hole 21 for receiving a web pressing roller 20 of the web pressing means 19 is formed in a unit case 22 thereof. The cleaning web 12 is wound in a roll on a web feeding roller 23 and the terminal end of the web 12 winding is fastened onto a web take-up roller 24. The web feeding roller 23 and the web take-up roller 24 are retained in the unit case 22 on respective roller shafts 25 and 26. As shown in FIG. 2, the mutually opposite ends of the roller shafts 25 and 26 forms a spline shaft that intermeshes with the web take-up section 17.

Referring to now to FIGS. 1 and 3, a cleaning unit 13 after being used on the heating roller 3 end is withdrawn from the unit loading receptacle 14, turned 180 degrees around and then inserted into the unit loading receptacle 15 on the pressure roller 4 end. Therefore, roller 24 that until then has been for web take-up becomes a web feeding roller 23. Likewise, roller 23 that has been for web feeding becomes a web take-up roller 24. Herein the web take-up section 17 of the web winding means 18 is on the same side of the fixing station (i.e., the right side in the figures) on either the heating roller 3 or pressure roller 4 end.

Alternatively, wherein the web take-up section 17 of the web winding means 18 on the pressure roller 4 end is functional on the opposite side of the fixing station (i.e., the left side in the figures), the cleaning unit 13 after being used on the heating roller 3 end is withdrawn from the unit loading receptacle 14, and replaced in the same orientation into the unit loading receptacle 15 on the pressure roller 4 end. In this case, roller 24 that has been for web take-up remains in position, and is then unwound to function as a web-feeding roller; the converse is true for roller 23 that has been for web feeding.

In the web pressing means 19, arms 29, 29 of a pair provided on either end of a rod 28 pivotably manipulable by a lever 27 are each perforated distally by an elongate hole b. A rod 30 is installed between the arms 29, 29 slidably engaging at either end with the elongate holes b. Lifters 32, 32 are constrained to slide vertically within respective guides 31, 31 (shown in FIG. 1), and are disposed in alignment on either end of the rod 30. The web pressing roller 20 is rotatably mounted between the lifters 32, 32. Accordingly, the web pressing means 19 is configured such that the pressure of the web pressing roller 20 against the corresponding fixing roller surface can be released by manipulating the lever 27 when loading/unloading the cleaning unit 13.

Figure 5:
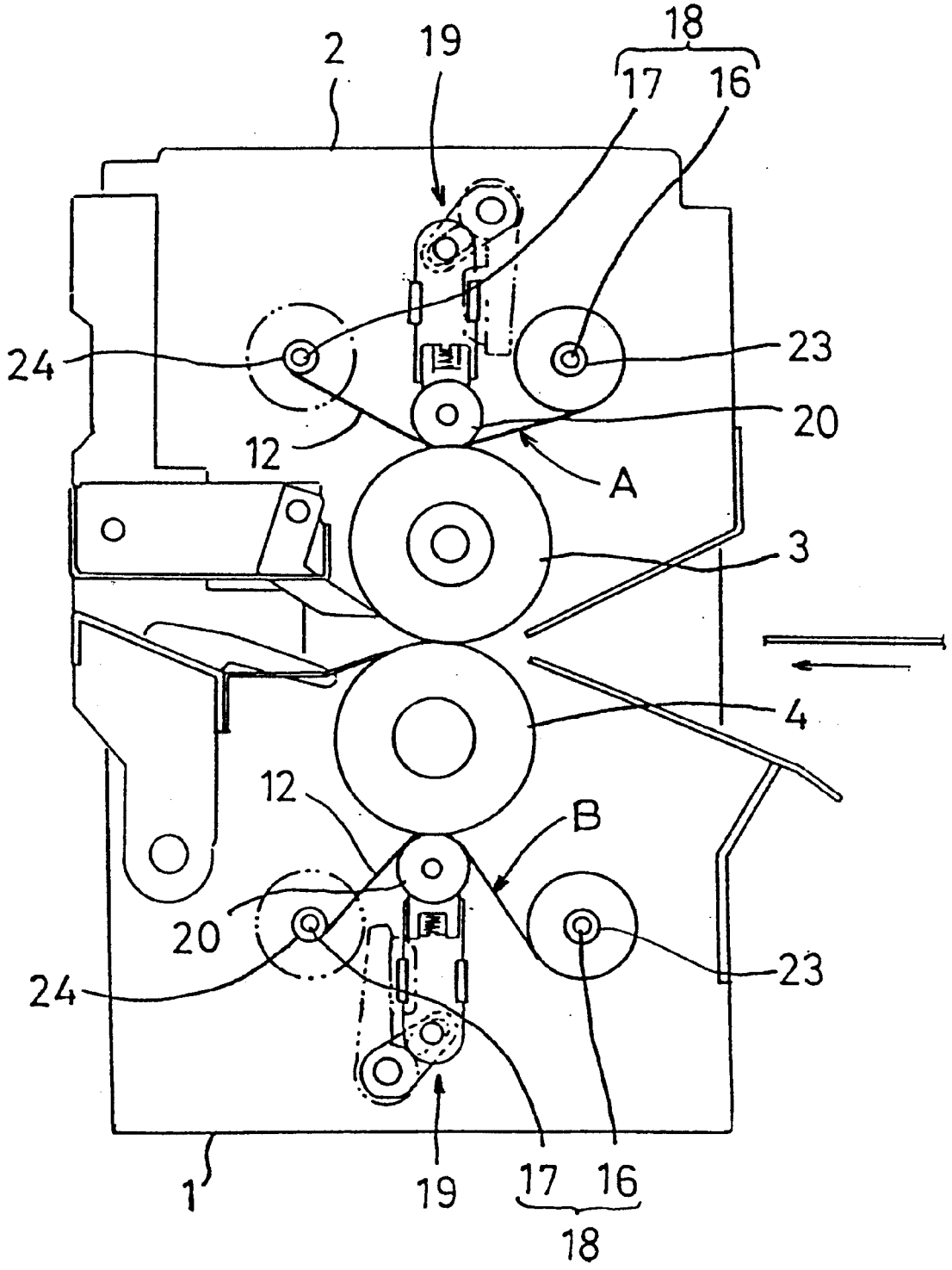
FIG. 5 is cross-sectional elevation corresponding to FIG. 1 of a fixing station in an electrostatographic printing apparatus in which cleaning webs in a non-unit configuration in accordance with an alternate embodiment of the present invention are installed.

With the provision of the unit loading receptacles 14 and 15 on the heating roller 3 and pressure roller 4 ends, respectively, of the fixing station in the forgoing embodiment, the cleaning web 12 in the cleaning unit 13 can be exchanged in cassette-fashion. Alternatively, as shown in FIG. 5, the web winding means 18 comprising the web feeding section 16 and web take-up section 17 can alone be provided on the respective heating roller 3 end and pressure roller 4 end of an electrostatographic fixing station. The web supply section 16 having the web feeding roller 23 on which an unused cleaning web 12 is wound, and the web take-up section 17 having the web take-up roller 24, are thus set into position on the heating roller 3 end; when the cleaning web 12 therein has been used, i.e., when the cleaning web 12 taken up completely on the web take-up roller 24, the rollers 23, 24 are withdrawn, re-oriented as described above, and set into position in the web feeding section 16 and the web take-up section 17 of the web winding means 18 on the pressure roller 4 end.

Thus the present invention takes advantage of the fact that since parting agent applied to the heating roller transfers to the pressure roller, the pressure roller can be sufficiently cleaned even with a cleaning web containing reduced parting agent. This enables efficient cleaning of the pressure roller by recycling use of the disposable cleaning web after its one side has served to clean the heating roller. Both sides of the cleaning web are utilized, resulting in economical cleaning of the heating roller and pressure roller, without need of and complicated technique for differentially adjusting the amount of parting agent applied to the respective fixing unit rollers.

Various details of the present invention may be changed without departing from its spirit nor its scope. Furthermore, the foregoing description of the embodiments according to the present invention are provided for illustration only, and not for the purpose of limiting the invention as defined by the appended claims and their equivalents.

What is claimed is:

1. A cleaning web device employed in a fixing station including a heating roller and a pressure roller pressing against each other, wherein cleaning web rolls are brought into superficial contact with the heating roller and the pressure roller for cleaning the heating roller and pressure roller as the rollers rotate, the cleaning web device comprising:

an unused cleaning web roll containing a parting agent, the cleaning web roll being set over a first web feeder and web winder disposed on a heating roller end of the fixing unit, wherein one side of the cleaning web is brought into superficial contact with the heating roller to clean the surface thereof; the cleaning web device characterized in that:

a cleaning web device having its cleaning web roll wound off said web feeder and onto said web winder in completed use on the heating roller end is set over a second web feeder and web winder disposed on a pressure roller end of the fixing unit to replace a cleaning web device previously set therein, wherein the other side of the cleaning web roll is brought into superficial contact with the pressure roller to clean the surface thereof.

2. A method of using a recyclable cleaning web in a device containing a cleaning web winding on respective rollers for feed and take-up in an electrostatographic fixing station including a heating roller, a web-pressing means disposed axially adjacent the heating roller, a pressure roller pressing on the heating roller, and a web-pressing means disposed axially adjacent the pressure roller, the method comprising the steps of:

installing a cleaning web axially adjacent the heating roller in a first orientation, the cleaning web therein winding off the feed roller and onto the take-up roller, wherein the heating roller web-pressing means presses a first surface of the cleaning web against the heating roller; and removing a cleaning web having been installed in the first orientation and wound off the feed roller and onto the take-up roller in completed first-orientation use, and installing said cleaning web axially adjacent the pressure roller in second orientation, the second orientation being the first orientation turned approximately 180° around an axis perpendicular to a plane through the rollers for feed and take-up, wherein the pressure roller web-pressing means presses a second surface opposite the first surface of the cleaning web against the pressure roller.

3. A method of using a recyclable cleaning web unit as set forth in claim 2, wherein when the cleaning web unit is installed axially adjacent the heating roller, the roller therein for take-up is engageable with a corresponding take-up roller drive means of the fixing station, and when the cleaning web unit is installed axially adjacent the pressure roller in the second orientation the roller therein for take-up is likewise engageable with the take-up roller drive means of the fixing station; the method further comprising the step of driving the take-up roller drive means in the same direction when said cleaning web is installed axially adjacent the heating roller and when said cleaning web is installed axially adjacent the pressure roller.

4. A method of using a recyclable cleaning web in a device containing a cleaning web winding on respective rollers for feed and take-up in an electrostatographic fixing station including a heating roller, a web-pressing means disposed axially adjacent the heating roller, a pressure roller pressing on the heating roller, and a web-pressing means disposed axially adjacent the pressure roller, the method comprising the steps of:

installing a cleaning web axially adjacent the heating roller in a predetermined orientation, the cleaning web therein winding off the feed roller and onto the take-up roller, wherein the heating roller web-pressing means presses a first surface of the cleaning web against the heating roller; and removing a cleaning web having been installed axially adjacent the heating roller and having its cleaning web wound off the feed roller and onto the take-up roller in initial use, and installing said cleaning web axially adjacent the pressure roller in the predetermined orientation, wherein the pressure roller web-pressing means presses a second surface opposite the first surface of the cleaning web against the pressure roller.

5. A method of using a recyclable cleaning web as set forth in claim 4, wherein when the cleaning web is installed axially adjacent the heating roller the roller therein for take-up is engageable with a corresponding first take-up roller drive means of the fixing station, and when the cleaning web is installed axially adjacent the pressure roller in the predetermined orientation the roller therein for take-up is engageable with a corresponding second take-up roller drive means of the fixing station; the method further comprising the steps of driving the first and second take-up roller drive means in reverse directions when said cleaning web is installed axially adjacent the heating roller and when said cleaning web is installed axially adjacent the pressure roller.

6. A cleaning web device employed in a fixing station including a heating roller and a pressure roller pressing against each other, wherein cleaning web rolls are brought into superficial contact with the heating roller and the pressure roller for cleaning the heating roller and pressure roller as the rollers rotate, the cleaning web device comprising:

a pair of cleaning web units, each including a unit case in which an aperture is formed, housing a pair of rollers on which a cleaning web is wound and a means for winding the cleaning web; and a pair of unit loading receptacles disposed respectively above the heating roller and below the pressure roller, the unit loading receptacles each being provided with a pressing roller that can releasably press the cleaning web of an installed cleaning web unit against the surface of the heating roller and the pressure roller respectively through the aperture in the unit case; the cleaning web device characterized in being configured such that:

the unit loading receptacle above the heating roller, into which an unused cleaning web unit containing a parting agent is set, brings one side of the cleaning web into contact with the surface of the heating roller; and the unit loading receptacle below the pressure roller into which a cleaning unit is set containing a cleaning web one side of which has been used on the heating roller, brings the other side of the cleaning web into contact with the surface of the pressure roller.

7. A recyclable cleaning web for use in an electrostatographic fixing station including a heating roller, a web-pressing means disposed axially adjacent the heating roller, a pressure roller pressing on the heating roller, and a web-pressing means disposed axially adjacent the pressure roller, the cleaning web comprising:

a pair of web winding rollers mounted on respective axles for feed and take-up; wherein said cleaning web is configured to be installable axially adjacent the heating roller in a first orientation, the heating roller web-pressing means therein pressing a first surface of said cleaning web against the heating roller, and to be installable axially adjacent the pressure roller in the first orientation and in a second orientation, the second orientation being the first orientation turned approximately 180° around an axis perpendicular to a plane through the axles for feed and take-up, the pressure roller web-pressing means therein pressing a second surface opposite said first surface of said cleaning web against the pressure roller.

8. A recyclable cleaning web as set forth in claim 7, said cleaning web being installed axially adjacent the heating roller, the axle therein for take-up is engageable with a corresponding first take-up axle drive means of the fixing station, and said cleaning web being installed axially adjacent the pressure roller in the first orientation, the axle therein for take-up is engageable with a corresponding second take-up axle drive means of the fixing station; wherein the first and second take-up axle drive means drive the axle for take-up in reverse directions with said cleaning web installed axially adjacent the heating roller and with said cleaning web installed axially adjacent the pressure roller.

9. A recyclable cleaning web as set forth in claim 7, said cleaning web being installed axially adjacent the heating roller, the axle therein for take-up is engageable with a corresponding take-up axle drive means of the fixing station, and said cleaning web being installed axially adjacent the pressure roller in the second orientation, the axle therein for take-up is likewise engageable with the take-up axle drive means of the fixing station; wherein the take-up axle drive means drives the axle for take-up in the same direction with said cleaning web installed axially adjacent the heating roller and with said cleaning web installed axially adjacent the pressure roller.

10. A recyclable cleaning web device for use in an electrostatographic fixing station including a heating roller and a pressure roller pressing on the heating roller, the cleaning web device comprising:

a pair of unit loading receptacles, one each disposed axially adjacent the heating roller and disposed axially adjacent the pressure roller;

a heating roller web-pressing means and a pressure roller web-pressing means;

a cleaning web unit including an axially symmetrical case having a central through-hole, therein defining substantially parallel axial roller housings; and a pair of web winding rollers, one each being housed in said axial roller housings and mounted therein on respective axles for feed and take-up; wherein said cleaning web unit is configured to be installable axially adjacent the heating roller in a first orientation, the heating roller web-pressing means therein being operable through said through-hole to press a first surface of said cleaning web against the heating roller, and to be installable axially adjacent the pressure roller in the first orientation and in a second orientation, the second orientation being the first orientation turned approximately 180° around an axis perpendicular to a plane through the axles feed and take-up, the pressure roller web-pressing means therein being operable through said through-hole to press a second surface opposite said first surface of said cleaning web against the pressure roller.

11. A recyclable cleaning web device as set forth in claim 10, said cleaning web unit being installed axially adjacent the heating roller, the axle therein for take-up is engageable with a corresponding first take-up axle drive means of the fixing station, and said cleaning web unit being installed axially adjacent the pressure roller in the first orientation, the axle therein for take-up is engageable with a corresponding second take-up axle drive means of the fixing station; wherein the first and second take-up axle drive means drive the axle for take-up in reverse directions with said cleaning web unit installed axially adjacent the heating roller and with said cleaning web unit installed axially adjacent the pressure roller.

12. A recyclable cleaning web device as set forth in claim 10, said cleaning web unit being installed axially adjacent the heating roller, the axle therein for take-up is engageable with a corresponding take-up axle drive means of the fixing station, and said cleaning web unit being installed axially adjacent the pressure roller in the second orientation, the axle therein for take-up is likewise engageable with the take-up axle drive means of the fixing station; wherein the take-up axle drive means drives the axle for take-up in the same direction with said cleaning web unit installed axially adjacent the heating roller and with said cleaning web unit installed axially adjacent the pressure roller.

* * * * *